United States Patent [19]

Mark

[11] Patent Number: 4,671,500

[45] Date of Patent: Jun. 9, 1987

[54] DOUBLE ACTING CLAMP

[76] Inventor: William J. Mark, 473 W. Grace St., Bedford, Ohio 44146

[21] Appl. No.: 768,630

[22] Filed: Aug. 23, 1985

[51] Int. Cl.[4] ..... B25B 1/14

[52] U.S. Cl. ..... 269/228; 269/134; 269/155; 269/219

[58] Field of Search ..... 269/134, 152, 155, 219, 269/221, 228, 287, 218, 256

[56] References Cited

U.S. PATENT DOCUMENTS

| | | | |
|---|---|---|---|
| 1,372,833 | 3/1921 | Sauer | 269/228 |
| 1,757,548 | 5/1930 | Schissler | 269/228 |
| 2,165,614 | 7/1939 | Look et al. | 269/228 |
| 2,518,112 | 8/1950 | Anthony | 269/221 |
| 3,024,521 | 3/1962 | Polk | 269/219 |
| 4,456,043 | 6/1984 | Stocks | 269/221 |

*Primary Examiner*—Frederick R. Schmidt

*Assistant Examiner*—Judy J. Hartman

*Attorney, Agent, or Firm*—Donald A. Bergquist

[57] ABSTRACT

A symmetrical clamping device for producing bonded uniform panels from narrow strips of wood as well as laminated boards glued together. Includes two relatively long guide plates provided with appropriate linkage mechanism capable of exerting pressure to the entire surface being clamped while applying force to the ends in a direction that is perpendicular to that surface when actuated manually by way of appropriate jack screws disposed at each end of the guide plates or automatically by using power cylinders in combination with linkage and an end bolt incorporated therein, to insure participation of bondable material in the process of clamping and conformation to the surfaces of guide plates which may have a straight flat surface or an irregular shape so as to produce desired final product.

7 Claims, 4 Drawing Figures

DOUBLE ACTING CLAMP

FIELD OF THE INVENTION

This invention relates to clamping fixtures in general, covered by class 269, and to double acting clamping devices in particular, with a search conducted in subclasses 104, 218, 219, 228, 240, and 256.

BACKGROUND OF THE INVENTION

The process of producing bonded panels from narrow strips of wood, plastics or the like has required conventional doweling along with the use of glue, often with temperature control for maximum strength. With the advent of improved glues containing plastics, this bonding process could be simplified by the introduction of improved clamping means that eliminate conventional dowel pins therefrom altogether, in particular if such improved clamping means permit application of well distributed pressure to the entire surface to be bonded, which is not attainable by conventional clumsy use of pipe clamps or the like.

Prior art patent search conducted in the class 269 with noted sub-classes failed to identify any improvements in the clamping devices. In fact, there is very little in the way of improvements for producing uniform bonded panels including laminated boards glued together from wood or other materials.

It is therefore an object of the present invention to provide novel means for bonding strips of wood or the like in a device that is simple and effective.

A more specific object of the present invention is to improve the process of making panels or boards by utilization of drastically different clamping techniques.

A final object of the present invention is to provide a double acting clamp for production of bonded panels without doweling by the utilization of guide plates in conjunction with an appropriate linkage mechanism which forces participation of the bonded material to conform to the guide edge of the clamp surfaces, be it straight or irregular as dictated by the shape of the end product.

These and other objects and advantages of the invention will be apparent from the following specification and drawings identifying certain typical embodiments thereof.

SUMMARY OF THE INVENTION

A double acting clamp for producing symmetrical uniformly bonded panels from narrow strips of wood or the like, including laminated boards glued together, incorporates two guide plates that are relatively long and serve as a receiver of bondable material in a gap created therebetween, wherein a lower guide plate serves as a base for material loading while the upper guide plate serves as a clamping guide means with a force acting downward toward the lower guide plate, so as to insure that the bonding material lays flat between the guide plates at all times in conformation to contour lines the clamping surfaces provide, be it straight edge or irregular shape, depending on the requirements of the end product. This type of symmetrical clamping can be accomplished by the utilization of linkages capable of exerting pressure over the entire surface clampled while applying force to the ends directly over the edges of the material subject to bonding, thereby exerting not only downward force but also a simultaneous side force which in combination provides clamping means unattainable with other devices of prior art and, in effect, permits fabrication of rather wide panels without conventional doweling, resulting in a less costly and better quality product. In effect, this device includes prior art elements which in novel combination provides new synergetic results.

DETAILED DESCRIPTION OF THE DRAWINGS

Figure 1:
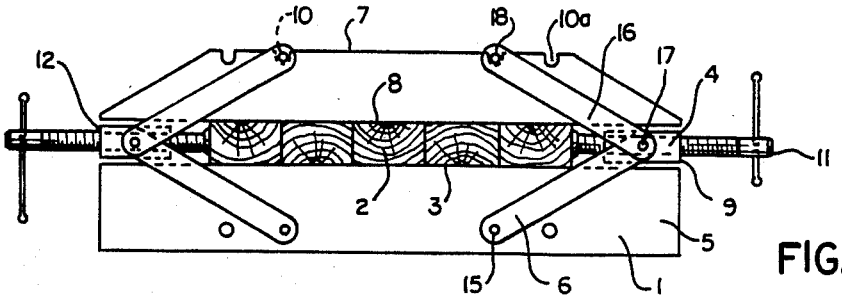
FIG. 1 is a side view of a preferred embodiment showing a pair of guide plates interconnected by a linkage mechanism which in combination serves as a basis for this invention.

FIG. 1 embodiment identifies an assembly of a double acting clamp 5 with a number of bondable wood strips 2 incorporated therein for processing to result in a flat uniform panel. Shown in FIG. 1 is a bottom guide plate 1 of rectangular configuration adaptable of receiving along its flat surface 3 a line of narrow wooden strips 2 of panel width as defined by the distance between the clamping mechanisms 4 disposed at each opposite end of guide plate 1, to which it is permanently hinged by a pivot 15 of a link 6. Wooden strips 2 of FIG. 1 are topped by a top guide plate 7 of an elongated configuration of the same width as that of plate 1 including identical flat surface 8 substantially parallel to the surface 3 along its entire length, thereby forming a gap between the top and bottom guides for loading and clamping material subject to a bonding process without doweling. By virtue of the structural arrangement of guide plates 1 and 7, which in parallel can force participation of bondable material to conform to the surfaces 3 and 8 respectively, substantial improvements in the process of bonding to result in flat panels is materialized. In particular, when this is done in conjunction with clamping mechanisms 4, of which a second link 16 pivoted by a first end 17 inside a trunnion 9 at each guide plate end can be anchored by a second end 18 of the second link 16 inside an appropriate notch 10 of the top guide plate 7. In combination with clamping mechanisms 4 the narrow strips of wood 2, spaced between the top and bottom guide plates 1 and 7 as shown in FIG. 1, can be subjected to large multidirectional forces. When clamping device 4 becomes actuated manually by way of a jack screw 11, which, when turned inside trunnion 9 from both ends, will not only exert tremendous side loading from opposite ends of the clamp 5, but also will yield a downward force perpendicular to the side force experienced endwise due to a force vector induced by the linkage coupled to both ends of the guide plates 1 and 7 respectively, clearly visible from FIG. 1, thereby facilitating uniform pressure over the surfaces of bondable material for process improvement beyond that known in prior art clamping devices. In effect, two guide plates plus a clamping mechanism incorporated into the opposite ends thereof will result in a simple double acting symmetrical clamping device for producing bonded uniform panels from narrow strips of wood or the like, including laminated boards glued together. In a panel making process, the device shown in FIG. 1 with simple actuating jack screws, can be modified to include power cylinders instead of jack screws for force application thereto, and/or otherwise changed without affecting the scope and the spirit of the present invention. This will become more fully apparent from the description of the design modifications by reference to FIG. 3.

Figure 2:
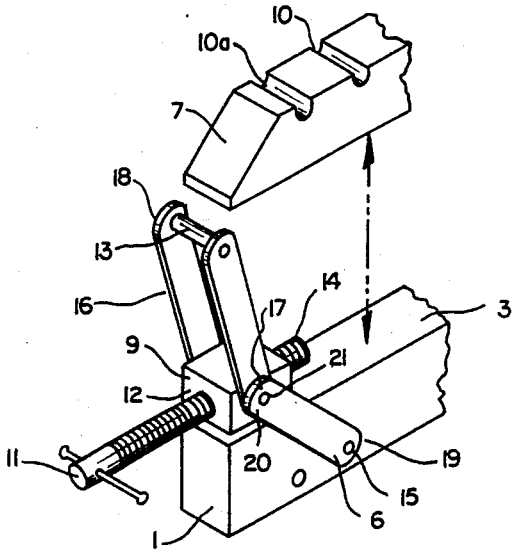
FIG. 2 is an end section of FIG. 1 executed in perspective to identify both sides of the double acting clamp of the present invention.

While FIG. 1 depicts all fundamental components of the double acting clamp 5 of the present invention, FIG. 2, showing an end view section in perspective, amplifies the structural details of this device somewhat better. Since the device 5 of FIG. 1 uses an identical clamping mechanism 4 in each opposite end thereof, it will suffice to discuss the construction of FIG. 2. FIG. 2 shows the trunnion 9, which is secured to the guide plate 1 by a pivot 15 of a first end 19 of link 6 of a first pair of links of which a second end 20 is pivoted at 21 to trunnion 9, and which trunnion is adaptable of moving sideways along the surface 3 when jack screw 11 is turned inside threaded hole 12 of trunnion 9 in order to have screw end 14 clamp against wood 2 for exerting side force with uniform pressure loading perpendicularly over the surface of wood 2 after anchoring roller 13 inside notch 10 of guide plate 7 of a second pair of links comprised of two identical parallel members 16, which link end 17 is also pivoted to trunnion 9 at 21 while the opposite end 18 thereof is interconnected with roller 13, thereby completing the assembly of mechanism 4 with functional characteristics it entails. It should be noted that in FIG. 2 the top guide plate 7 is lifted from the position shown in FIG. 1 for the purpose of illustrating two vital characteristics. First, is the fact that the design of the double acting clamp 5 entails basic simplicity in that it provides an easy access thereto for loading bondable material, such as strips of wood or the like, over the surface 3 when guide plate 7 is removed, as indicated in FIG. 2, and subsequently closed and secured by links 16 for clamping from both ends of the device so as to insure proper bonding process per FIG. 1 described. And secondly, by lifting guide plate 7 from the position shown in FIG. 1, the perspective view of FIG. 2 not only identifies relative thickness of the device, which is rather narrow, although not limited to that depicted therein, but also shows notches 10 and **10-*a* in a greater detail before roller 13 becomes engaged by anchoring therein in accordance with different widths of the panels being processed. A provision for panel width adjustment has been found quite helpful in practice. Finally, FIG. 2 also identifies corners of guide plate 7 beveled, more readily visible by reference to FIG. 1, for purpose of accomodating linkage of clamping mechanism 4, while otherwise guide plate 7 is not much different from the guide plate 1** in width and thickness, unless purposely modified.

Figure 3:
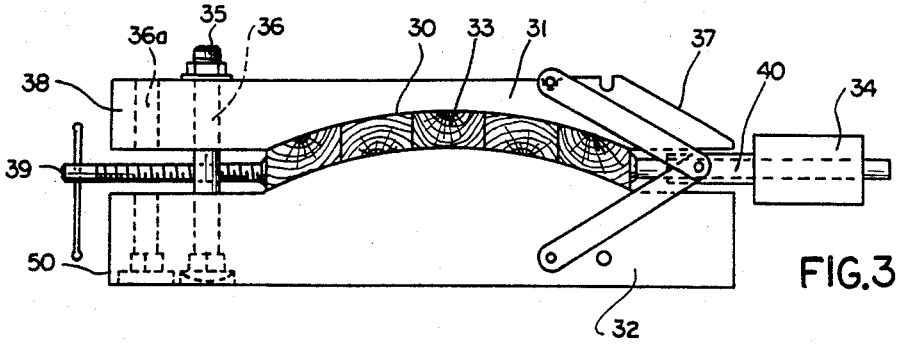
FIG. 3 is a side view of modified top guide plate of FIG. 1 including optional actuators.

FIG. 3 identifies a modified configuration of a clamp 50 with operating and process requirements which may differ slightly from those shown and described by reference to FIG. 1 and FIG. 2 without affecting the basic structural features for improved loading and clamping materials subject to a bonding process under the present invention.

The most significant modification found in FIG. 3 is the arc 30 of the clamping surfaces of guide plates, of which the top guide plate 31 is shown with a concave surface for accomodation of narrow strips 33 of wood or the like material, while the bottom guide plate 32 includes a convex surface of the arc 30. It should be noted that this surface modification is not limited to flat of FIG. 1 or that of FIG. 3 because many other surfaces such as convoluted or the like can be incorporated into the guide plates for equal success in processing clamped material subject to bonding, as proven by actual work performed by the inventor during the process development. It was also found, during such experimentation, that some materials can be handled with equal success by the use of only one of the clamping mechanism 40, which in effect is functionally identical to that identified in FIGS. 1 and 2 except for the incorporation of a power cylinder 34 in lieu of jack screw 11, while the opposite clamp end can be provided with a through bolt 35 spaced inside one of the bolt holes 36 or **36-*a*, depending on the panel width dimensions, namely if the panel is wide, hole 36-*a* may be used for bolt 35 in a device of clamp 50 of FIG. 3 as well as in clamp 5 of FIG. 1 with equal success. Likewise, mechanism 4 of FIGS. 1 and 2 can be employed with equal success in the device of FIG. 3 replacing the power cylinder actuated mechanism 40. Otherwise, mechanism 40 of FIG. 3 includes an identical linkage system identified by discussing FIGS. 1 and 2, which identification is omitted from FIG. 3 discussion to prevent redundance. To note is the fact that the shape of the guide plate 31 externally is somewhat different from guide plate 7 of FIG. 1 because it does not have both corners beveled in FIG. 3 as opposed to FIGS. 1 and 2. In fact, the top guide plate 31 externally may have only one corner beveled as shown by 37 while the opposite corner thereof is square as shown by 38**.

Another modification in FIG. 3 relates to jack screw 39 which can be incorporated into the center of bolt 35 to accomodate additional force application from both sides of the clamping material if and when needed, thereby facilitating optional means for controlling panel width as well, applicable with equal success to FIG. 1 device 5.

Figure 4:
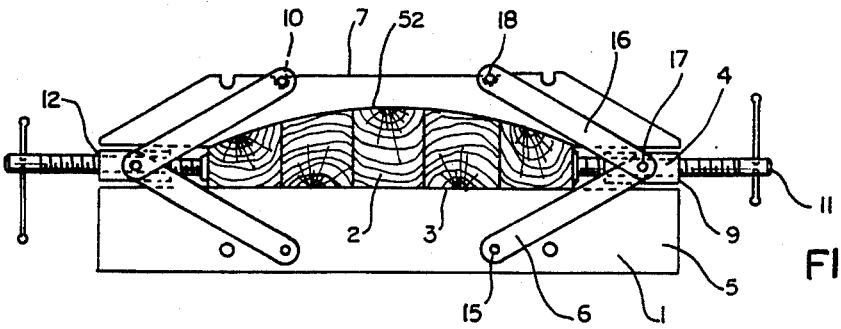
FIG. 4 is a side view of a modified guide plate of FIG. 1 including a curved top guide plate surface only.

FIG. 4 shows an embodiment of the present invention with parts identified as in the description of FIG. 1, but with surface 52 of the top guide plate 7 curved to accommodate the curved top surface of the end product made from individual strips of wood 2, while the surface 3 of the lower guide plate 1 is flat.

Without exception, the designs shown in FIGS. 1, 2, 3, and 4 identify the mose versatile and simple double acting clamp. However, some changes may be made in the construction and arrangement of details indeed without departing from the real spirit and scope of this invention, disclosed and claimed herein.

What is claimed is:

1. A clamp fixture for producing uniform panels having top and bottom surfaces, side surfaces, and end surfaces, from narrow strips of wood, said fixture comrising: two guide plates that serve as a receiver of bondable material in a gap created therebetween, wherein a surface of a lower guide plate serves as a base for material loading when an upper guide plate is removed and subsequently, after loading, becomes placed over the surface of said material so as, together with said lower guide plate, in conjunction with a clamping mechanism disposed in an operating relationship inside said gap at each opposite end of said guide plates, to serve as a clamping means with a multidirectional force, said clamping mechanism comprising two end clamps wherein each of said end clamps comprises a pair of links of which each link has a first link end pivoted to a trunnion that is movable between said guide plates in a gap created therebetween by said panel while each second link end is pivotally attached to a respective said guide plate adjacent ends thereof, including a jack screw along a threaded hole of said trunnion movable inwardly therein against said panel strips so as to develop said multidirectional forces when said jack screw is turned on each side of said guide plates against said material, whereby the entire top and bottom surfaces are clamped, while applying a simultaneous force to the side surfaces of a predetermined width of panels, said width being defined by the distance between said clamping mechanisms, which width may be adjustable.

2. A clamp fixture for producing uniform panels having top and bottom surfaces, side surfaces, and end surfaces, from narrow strips of wood, said fixture comprising: two guide plates that serve as a receiver of bondable material in a gap created therebetween, wherein a surface of a lower guide plate serves as a base for material loading when an upper guide plate is removed and subsequently, after loading, becomes placed over the surface of said material so as, together with said lower guide plate, in conjunction with a clamping mechanism disposed in an operating relationship inside said gap at each opposite end of said guide plates, to serve as a clamping means with a multidirectional force, said clamping mechanism comprising two end clamps wherein said end clamps comprise a combination of clamping means in each opposite end of said guide plates wherein a first end thereof comprises a trunnion with a pair of links pivoted thereto by a first link end while a second link end is pivotally attached to said first end of said guide plates, and a second end of said guide plates is adaptable to receive a through bolt in a perpendicular hole adjacent ends of said guide plates interconnecting both top and bottom guide plates so as to permit clamping of said panels by said through bolt at said second end of said guide plates while said first end thereof is provided with said trunnion which is movable sideways between said guide plates in a gap created therebetween by said panel when a jack screw is turned inside a threaded hole of said trunnion to develop a clamping force over said panels, whereby the entire top and bottom surfaces are clamped, while applying a simultaneous force to the side surfaces of a predetermined width of panels, said width being defined by the distance between said clamping mechanisms, which width may be adjustable.

3. A clamping device as in claim 1 or 2 wherein said surfaces of said guide plates are flat and parallel.

4. A clamping device as in claim 1 or 2 wherein said surfaces of said guide plates are contoured.

5. A clamping device as in claim 1 or 2 wherein said surfaces of said guide plates incorporate one flat surface and one contoured surface.

6. A clamping device as in claim 1 or 2 wherein at least one of said jackscrew clamping mechanisms is replaced by a power cylinder energizable by a pressurized working fluid.

7. A clamping device as in claim 1 or 2 wherein at least one end of said guide plates adjacent said clamping means is beveled.

* * * * *